US011642604B1

(12) United States Patent
Xie

(10) Patent No.: US 11,642,604 B1
(45) Date of Patent: May 9, 2023

(54) MAGNETIC ATTRACTION TOY

(71) Applicant: Shenzhen Jiaxin Technology Co., Ltd, Shenzhen (CN)

(72) Inventor: Penghui Xie, Shenzhen (CN)

( * ) Notice: Subject to any disclaimer, the term of this patent is extended or adjusted under 35 U.S.C. 154(b) by 0 days.

(21) Appl. No.: 18/077,551

(22) Filed: Dec. 8, 2022

(30) Foreign Application Priority Data

Nov. 9, 2022 (CN) ..... 202222985502.7

(51) Int. Cl.
*A63H 33/04* (2006.01)

(52) U.S. Cl.
CPC ..... *A63H 33/046* (2013.01)

(58) Field of Classification Search
CPC ..... A63H 33/04; A63H 33/046
See application file for complete search history.

(56) References Cited

U.S. PATENT DOCUMENTS 8,458,863 B2 * 6/2013 Hunts ..... H01F 7/0242 446/92
9,022,829 B2 * 5/2015 Rosen ..... A63H 33/046 446/131
9,457,288 B2 * 10/2016 Choi ..... A63H 33/084
9,636,600 B2 * 5/2017 Rudisill ..... A63H 33/046
9,643,100 B2 * 5/2017 Fein ..... A63H 33/046
10,080,977 B2 * 9/2018 Rosen ..... A63H 33/08
10,245,523 B2 * 4/2019 Lin ..... A63H 33/26
11,527,344 B2 * 12/2022 Kuo ..... E04B 2/7425
2006/0240737 A1 * 10/2006 Yoon ..... A63H 33/046 446/92
2016/0074766 A1 * 3/2016 Choi ..... A63H 33/046 446/92
2021/0213369 A1 * 7/2021 Yamaai ..... A63H 33/046

* cited by examiner

*Primary Examiner* — Kurt Fernstrom

(57) ABSTRACT

A magnetic attraction toy includes a base, a cover body, a magnetic, attraction member and a mounting frame. The magnetic attraction member is connected with the mounting frame. The base and/or the cover body is provided with a limiting gap for accommodating the magnetic attraction member. The base is also provided with locating pillars. The mounting frame is provided with locating holes. When the locating holes sleeve the locating pillars, the cover body is covered on the base. The magnetic attraction member includes a hollow iron tube and a magnet; the magnet is located in the iron tube. The first clamping end of the mounting frame is plugged to the first opening, and the second clamping end of the mounting frame is plugged to the second opening, so that the first and second clamping pieces clamp the iron tube, and the magnetic attraction member and the mounting frame are connected.

20 Claims, 6 Drawing Sheets

MAGNETIC ATTRACTION TOY

CROSS-REFERENCE TO RELATED APPLICATIONS

The application claims priority of Chinese patent application 202222985502.7, filed on 2022 Nov. 9, which is incorporated herein by reference in its entireties.

TECHNICAL FIELD

The present disclosure relates to the field of toys, in particular, to a magnetic attraction toy.

BACKGROUND 3D magnetic puzzle building blocks are increasingly popular toys in recent years, which can be used to build three-dimensional models and help develop, children's imagination. In most of existing magnetic attraction toys on the current market, a magnet is arranged in an internal cavity of a plastic shell. A magnetic force of the magnet through inner walls of two layers of plastic becomes relatively low, resulting, in a weak magnetic attraction force. As a result, the magnetic attraction toys can be used to build a limited number of three-dimensional models, and have low playability, which greatly affects the user experience. Therefore, there is an urgent need for providing a magnetic attraction toy with a low price, high acceptability, strong magnetic force, high strength, high safety and high playability, which is convenient for users to put out various models to improve the user experience.

SUMMARY

In order to overcome the shortcomings in the prior art, the present disclosure provides a magnetic attraction toy with a low price, high acceptability, strong magnetic force, high strength, high safety and high playability, which is convenient for users to put out magnetic attraction toys of various models to improve the user experience.

The technical solution adopted by the present disclosure to solve the technical problem is as follows: a magnetic attraction toy including a base, a cover body, a magnetic attraction member and a mounting frame, wherein the magnetic attraction member is connected with the mounting frame; the base and/or the cover body is provided with a limiting gap for accommodating, the magnetic attraction member; the base is also provided with locating pillars the mounting frame is provided with locating holes; when the locating holes sleeve the locating pillars, the cover body is covered on the base to stop the mounting frame in the base and to stop the magnetic attraction member in the limiting gap; the magnetic attraction member includes a hollow iron tube and a magnet; the magnet is located in the iron tube; one end of the iron tube is provided with a first opening; the other end of the iron tube is provided with a second opening; the mounting frame includes a first clamping piece and a second clamping piece; the first clamping piece is provided with a first connection end and a first clamping end; the second clamping piece is provided with a second connection end and a second clamping end; when the first clamping end is plugged to the first opening, and the second clamping end is plugged to the second opening, the first connection end is connected to the second connection end, so that the first clamping piece and the second clamping piece clamp the iron tube, and the magnetic attraction member and the mounting frame are combined into a whole.

As the improvement of the present disclosure, the first connection end is a groove, and the second connection end is a convex block matched with the groove; and when the first clamping end is plugged to the first opening, and the second clamping end is plugged to the second opening, the convex block is connected with the groove.

As the improvement of the present disclosure, the locating, pillars include a first locating pillar unit and a second locating pillar unit; the locating holes include a first locating hole unit formed in the first clamping piece and a second locating hole unit formed in the second clamping piece; when the first clamping end is plugged to the first opening and the second clamping end is plugged to the second opening, and when the first locating hole unit sleeves the first locating pillar unit and the second locating hole unit sleeves the second locating pillar unit, the cover body is covered on the base to stop the first locating pillar unit in the first locating hole unit and stop the second locating pillar unit in the second locating hole unit, so as to stop the mounting frame in the base; and the magnetic attraction member is stopped in the limiting gap.

As the improvement of the present disclosure, the cover body is provided with a stop edge; and when the cover body is covered on the base, the stop edge abuts against the first locating pillar unit and the second locating pillar unit to stop the first locating pillar unit in the first, locating hole unit and stop the second locating pillar unit in the second locating hole unit, so that the magnetic attraction member is stopped in the limiting gap.

As the improvement of the present disclosure, a raised first rib is also arranged on the base; and when the first clamping end is plugged to the first opening and the second clamping end is plugged to the second opening, and when the first locating hole unit sleeves the first locating pillar unit and the second locating hole unit sleeves the second locating pillar unit, the first clamping piece and the second clamping piece are both connected with the first rib by means of ultrasonic line welding.

As the improvement of the present disclosure, a raised second rib is arranged on the cover body; and when the first locating hole unit sleeves the first locating pillar unit and the second locating hole unit sleeves the second locating pillar unit, and when the cover body is covered on the base, the first clamping piece and the second clamping piece are both connected with the second rib by means of ultrasonic line welding.

As the improvement of the present disclosure, the first clamping piece and the second clamping piece are both plastic clamping pieces.

As the improvement of the present disclosure, one end of the magnet is an N pole, and the other end of the magnet is an S pole.

As the improvement of the present disclosure, a transverse length of the iron tube is greater than a transverse length of the magnet.

As the improvement of the present disclosure, the transverse length of the iron tube is twice the transverse length of the magnet.

The technical solution also adopted by the present disclosure to solve the technical problem is as follows: a magnetic attraction toy including a base, a cover body, a magnetic attraction, member and a mounting frame, wherein the magnetic attraction member is connected with the mounting frame; the base is provided with a limiting gap for accommodating the magnetic attraction member; the base is also provided with locating pillars; the mounting frame is provided with locating holes; when the locating holes sleeve the locating pillars respectively, the cover body is covered on the base to stop the mounting frame in the base so as to stop the magnetic attraction member in the limiting gap; the magnetic attraction member includes a hollow iron tube and a magnet; the magnet is located in the iron tube; one end of the iron tube is provided with a first opening; the other end of the iron tube is provided with a second opening; the mounting frame includes a first clamping piece and a second clamping piece; the first clamping piece is provided with a first connection end and a first clamping end; the second clamping piece is provided with a second connection end and a second clamping end; when the first, clamping end is plugged to the first opening, and the second clamping end is plugged to the second opening, the first connection end is connected to the second connection end, so that the first clamping piece and the second clamping piece clamp the iron tube, and the magnetic attraction member and the mounting frame are connected.

As the improvement of the present disclosure, the first connection end is a groove, and the second connection end is a convex block matched with the groove; and when the first clamping end is plugged to the first opening, and the second clamping end is plugged to the second opening, the convex block is connected with the groove.

As the improvement of the present disclosure, the locating pillars include a first locating pillar unit and a second locating pillar unit; the locating holes include a first locating hole unit formed in the first clamping, piece and a second locating hole unit formed in the second clamping piece: when the first clamping end is plugged to the first opening and the second clamping end is plugged to the second opening, and when the first locating hole unit sleeves the first locating pillar unit and the second locating hole unit sleeves the second locating pillar unit, the cover body is covered on the base to stop the first locating pillar unit in the first locating hole unit and stop the second locating pillar unit in the second locating hole unit, so as to stop the mounting frame in the base; and the magnetic attraction member is stopped in the limiting gap.

As the improvement of the present disclosure, the cover body is provided with a stop edge; and when the cover body is covered on the base, the stop edge abuts against the first locating pillar unit and the second locating pillar unit to stop the first locating pillar unit in the first locating hole unit and stop the second locating pillar unit in the second locating hole unit, so that the magnetic attraction member is stopped in the limiting gap.

As the improvement of the present disclosure, a raised first rib is also arranged on the base; and when the first clamping end is plugged to the first opening and the second clamping end is plugged to the second opening, and when the first locating hole unit sleeves the first locating pillar unit and the second locating hole unit sleeves the second locating pillar unit, the first clamping piece and the second clamping piece are both connected with the first rib by means of ultrasonic line welding.

As the improvement of the present disclosure, a raised second rib is arranged on the cover body; and when the first locating hole unit sleeves the first locating pillar unit and the second locating hole unit sleeves the second locating pillar unit, and when the cover body is covered on the base, the first clamping, piece and the second clamping piece are both connected with the second rib by means of ultrasonic line welding.

As the improvement of the present disclosure, the first clamping piece and the second clamping piece are both plastic clamping pieces.

As the improvement of the present disclosure, one end of the magnet is an N pole, and the other end of the magnet is an S pole.

As the improvement of the present disclosure, a transverse length of the iron tube is greater than a transverse length of the magnet.

As the improvement of the present disclosure, the transverse length of the iron tube is twice the transverse length of the magnet.

The beneficial effects of the present disclosure lie in: the present disclosure provides a magnetic attraction toy, including a base, a cover body v a magnetic attraction member and a mounting frame. The magnetic attraction member is connected with the mounting frame. The base and/or the cover body is provided with a limiting gap for accommodating the magnetic attraction member. The base is also provided with locating pillars. The mounting frame is provided with locating holes. When the locating holes sleeve the locating pillars, the cover body is covered on the base to stop the mounting frame in the base and to stop the magnetic attraction member in the limiting gap. The magnetic attraction member includes a hollow iron tube and a magnet. The magnet is located in the iron tube. One end of the iron tube is provided with a first opening. The other end of the iron tube is provided with a second opening. The mounting frame includes a first clamping piece and a second clamping piece. The first clamping piece is provided with a first connection end and, a first clamping end. The second, clamping piece is provided with a second connection end and a second clamping end. When the first clamping end is plugged to the first opening, and the second clamping end is plugged to the second opening, the first connection end is connected to the second connection end, so that the first clamping piece and the second clamping piece clamp the iron tube, and the magnetic attraction member and the mounting frame are combined into a whole. The magnetic attraction member can be exposed from the base and the cover body through the limiting gap. Compared with the prior art that a magnet is arranged in a plastic shell and fails in direct contact such that the magnetism is lowered, the present disclosure achieves direct contact between magnetic attraction toys, thus enhancing the first stage of magnetic force. Furthermore, the magnetic attraction member includes the iron tube and the magnet located in the iron tube, so that the transverse length of the iron tube can be set to be greater than that of the magnet. Specifically, the transverse length of the iron tube can be set to be twice that of the magnet, and the first clamping end and the second clamping end can be inserted into two ends of the iron tube, so that a magnetic attraction contact area between the magnetic attraction toys can be multiplied, and the magnet can still be fixed in a center position of the iron tube to provide a stronger and more stable magnetic attraction force, thus enhancing the second stage of magnetic force. In addition, the iron tube wrapping around the magnet makes magnetic induction lines around the magnet distributed intensively, so that the magnetic induction intensity around a surface of the magnetic attraction body becomes stronger, thus enhancing the third stage of magnetic force. A surface contact magnetic force of the magnetic attraction toy is enhanced by superposition of the enhancement of the three stages of magnetic forces, so that a user can put out a more three-dimensional, complicated and stable model using the magnetic attraction building blocks without increasing the cost for a strong magnet, and children's imagination can be developed more fully, which greatly increases the fun of experience of children. In addition, the first clamping piece and the second clamping piece are respectively clamped to two ends of the iron tube. On the one hand, the ribs welded with the first clamping piece and the second clamping piece are arranged on the base and the cover body, so that the number of welding lines is greatly increased, and a decrease in the quality of a product caused by difficulty in finding lack of weld is prevented. On, the other hand, the thickness of an entire plastic building block is greatly increased, so that the overall torque resistance and tensile strength are greatly improved in order that children think a toy building block body cannot be broken with bare hands. A safety threat caused by the following fact can be effectively avoided: when playing the toy, a child swallows the magnet carelessly since a toy shell is broken. The safety of the magnetics attraction toy is then improved. Further, every country does not allow strong magnets to be exposed in children's products. The magnet is, fixed in the iron tube, on the one hand, this regulation is met, on the other hand, magnetism of the magnetic attraction toy is improved.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
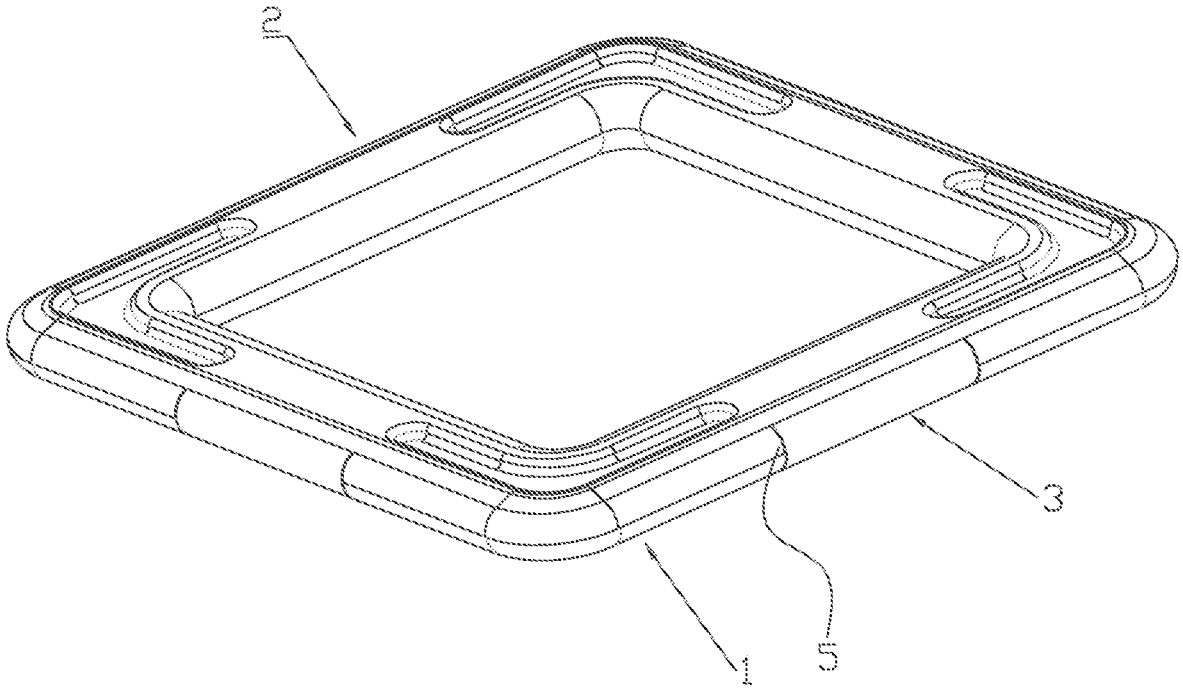
FIG. 1 is a schematic, diagram of an overall structure of the present disclosure.
Figure 2:
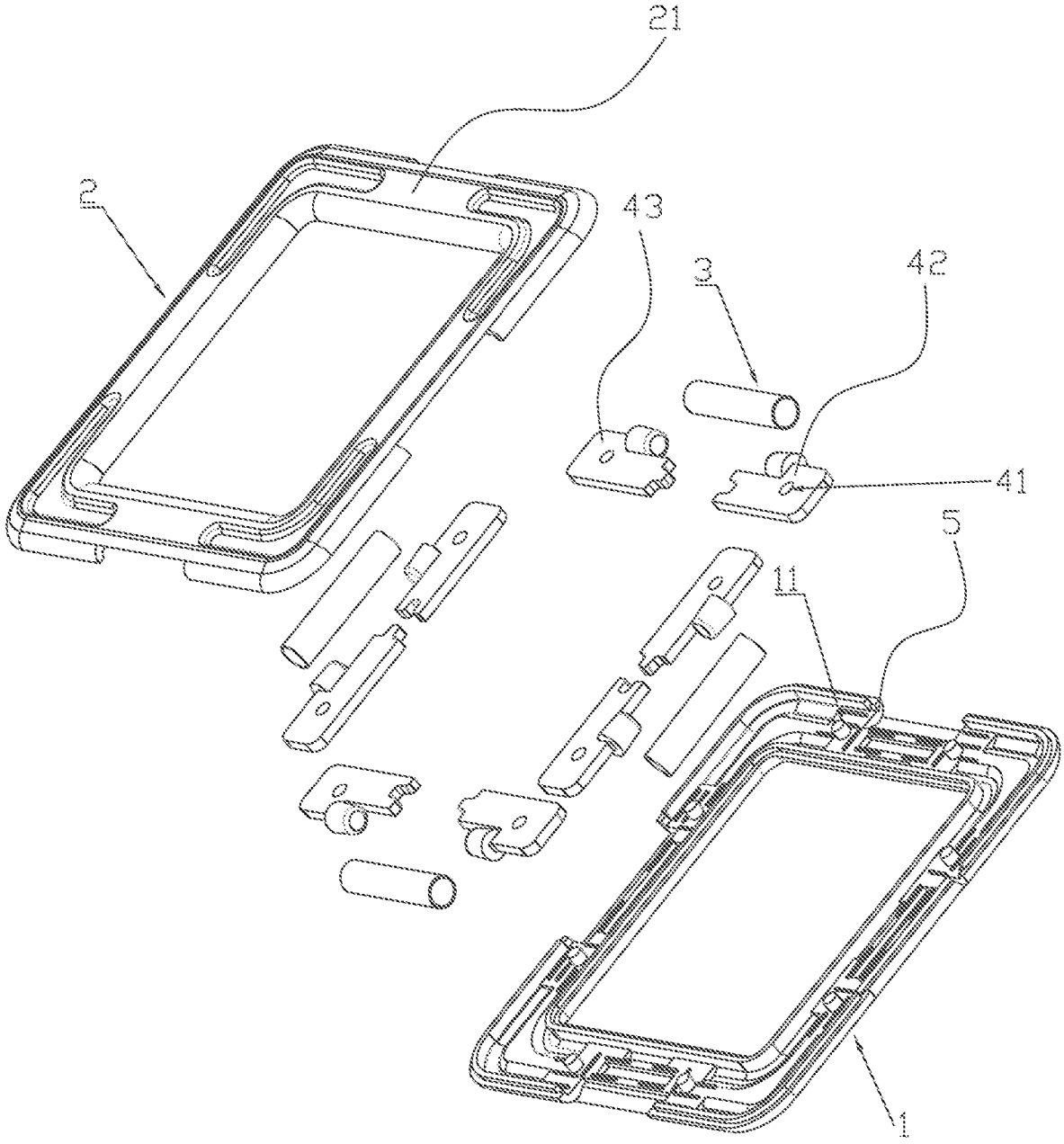
FIG. 2 is an exploded diagram of the present disclosure.
Figure 3:
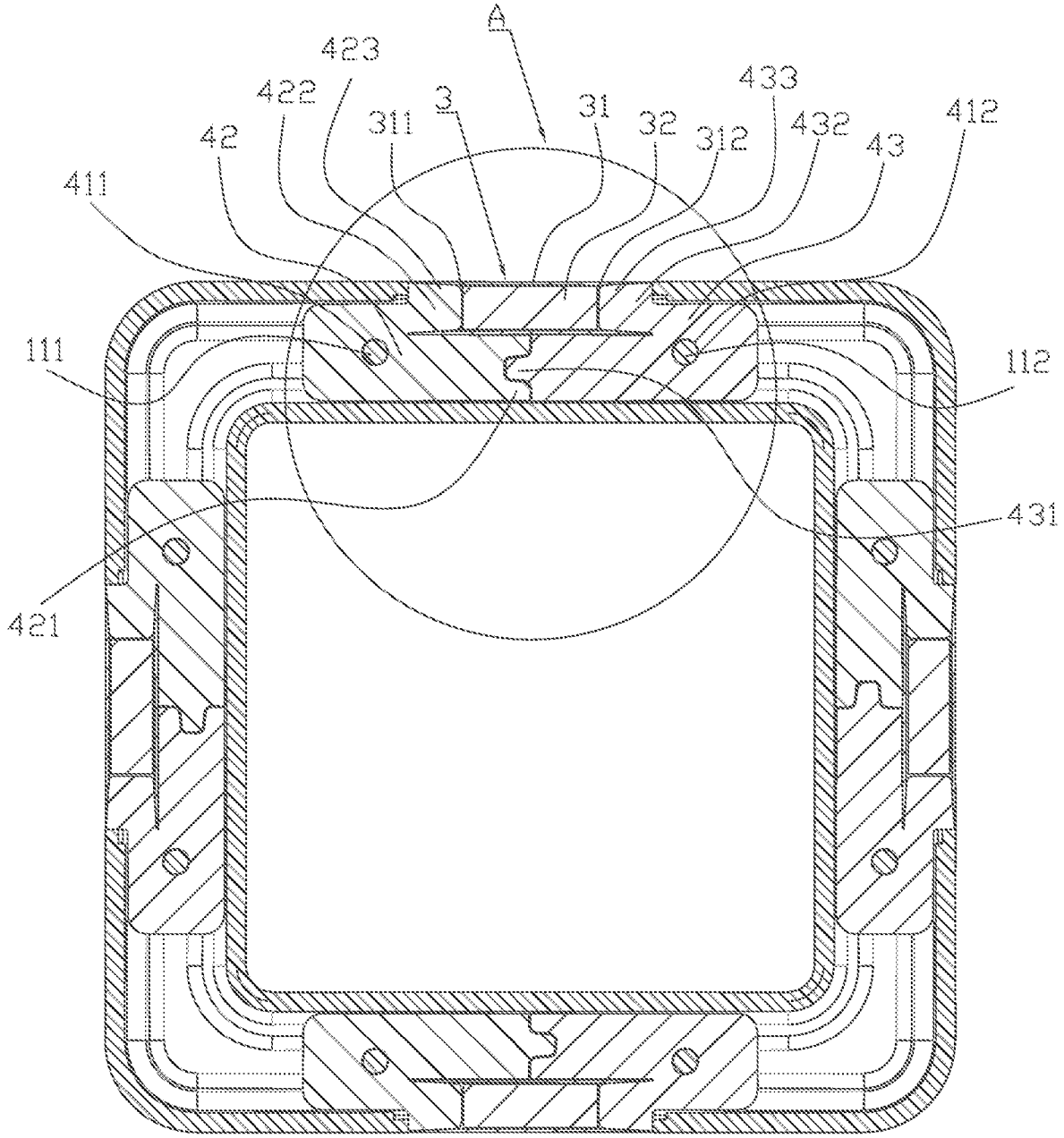
FIG. 3 is a sectional view of sectioning along a mounting frame and a magnetic attraction member.
Figure 4:
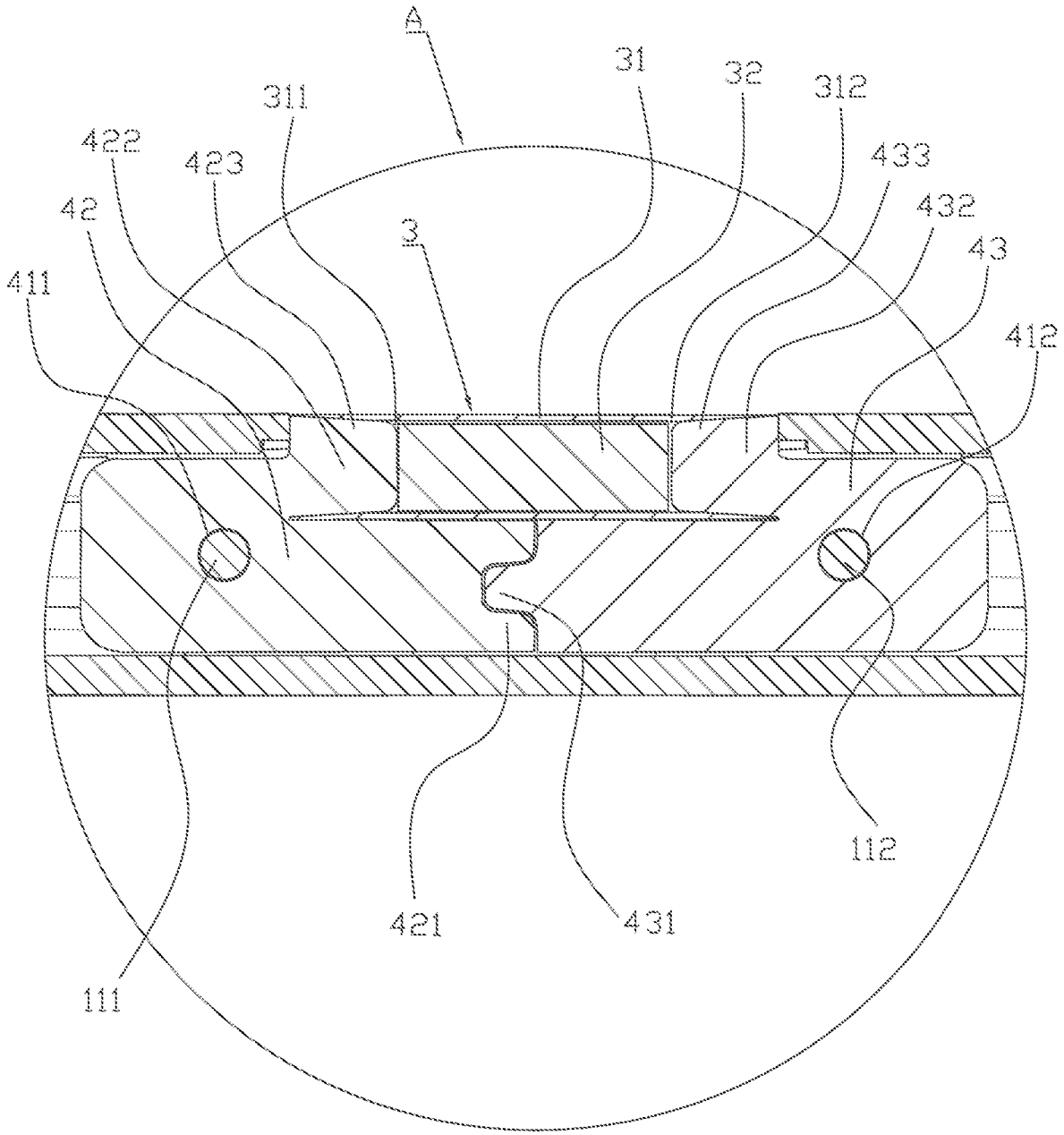
FIG. 4 is an enlarged diagram of the part A of FIG. 3.
Figure 5:
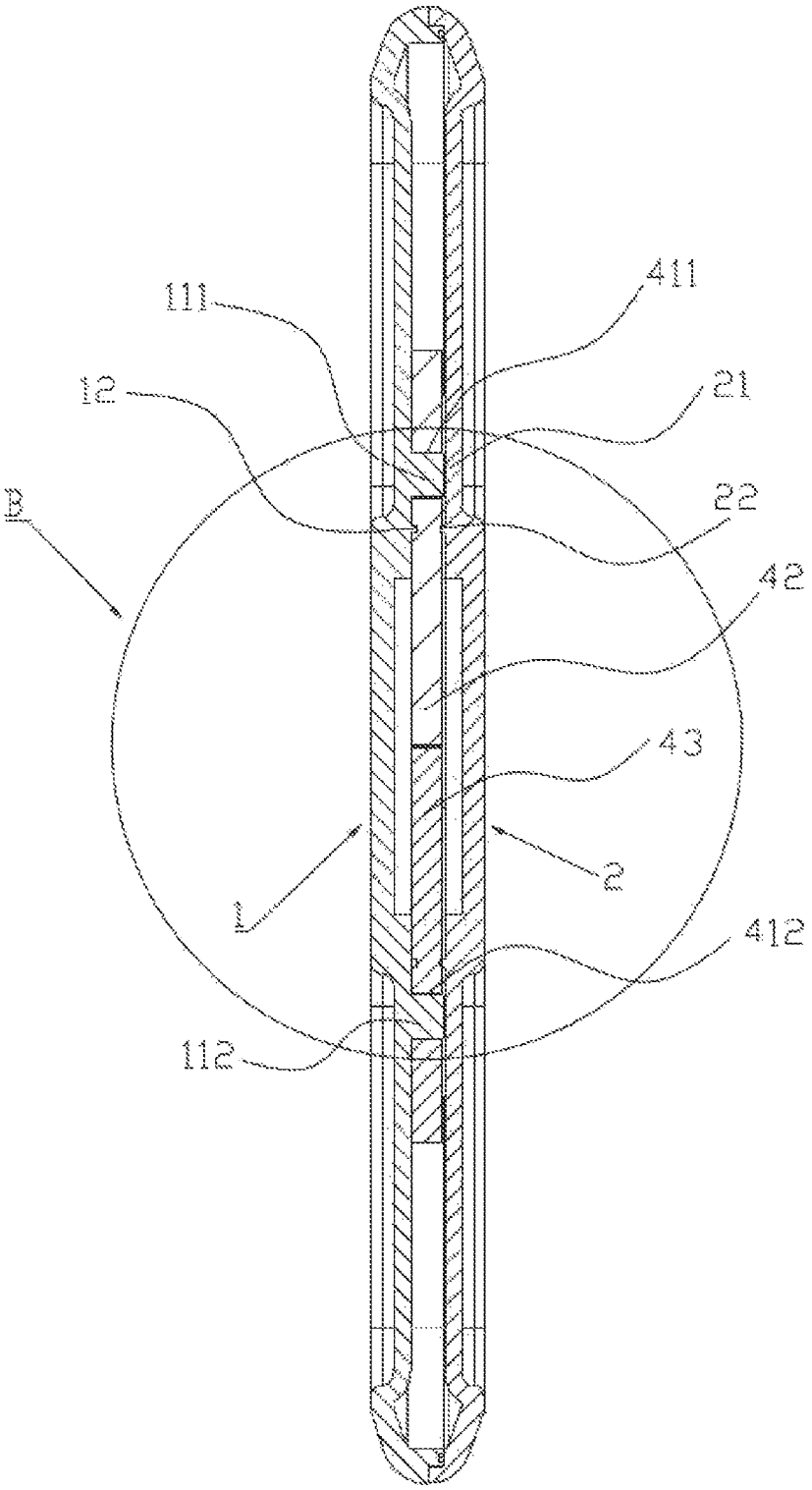
FIG. 5 is a sectional view of sectioning along locating pillars and locating holes.
Figure 6:
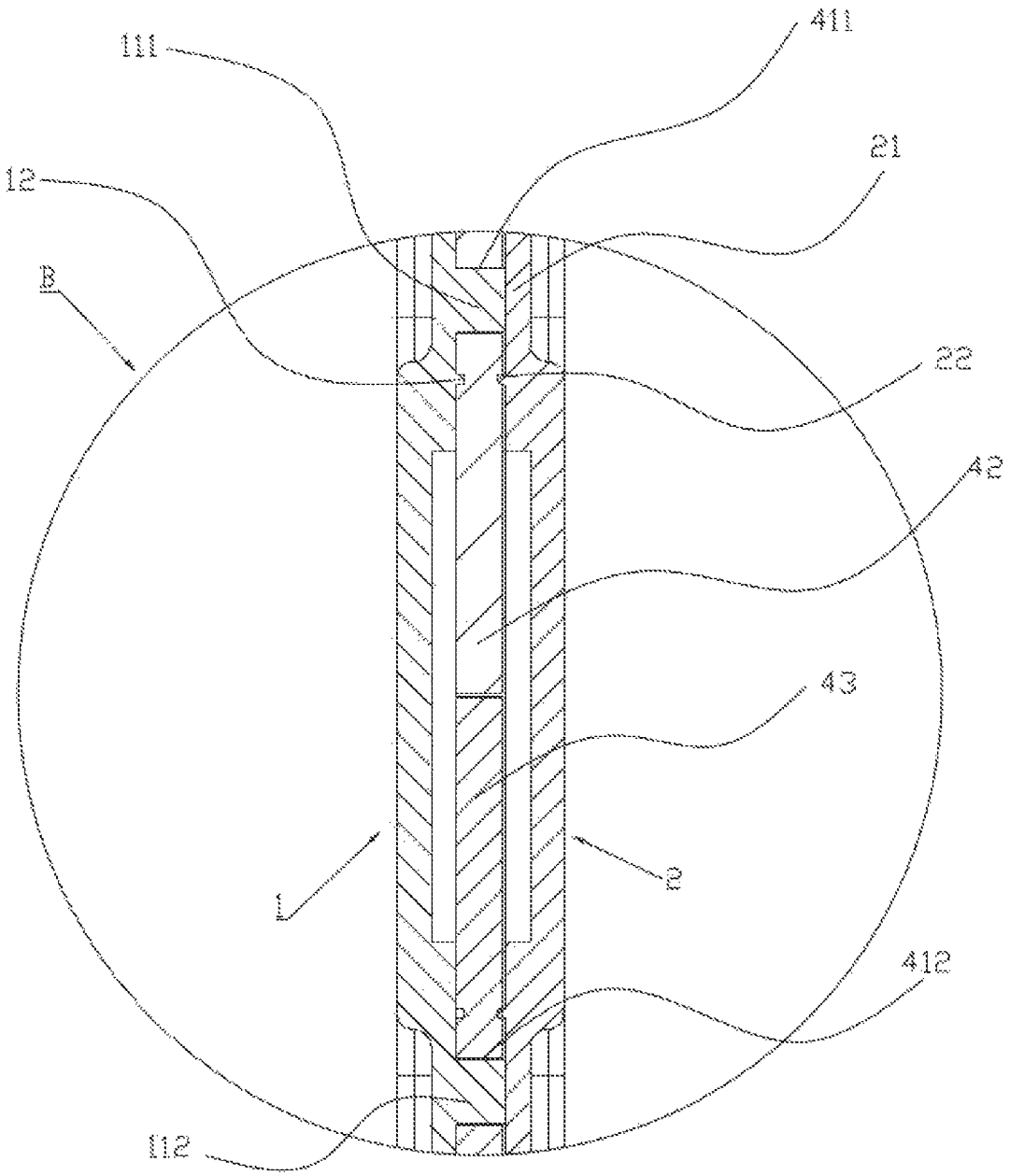
FIG. 6 is an enlarged diagram of the part B of FIG. 5.

Referring to FIG. 1 to FIG. 6, a magnetic attraction toy includes a base 1, a cover body 2, a magnetic attraction member 3 and a mounting frame 4. The magnetic attraction member 3 is connected with the mounting frame 4. The base 1 and/or the cover body 2 is provided with a limiting gap 5 for accommodating the magnetic attraction member 3. The base 1 is also provided with locating pillars 11. The mounting frame 4 is provided with locating holes 41. When the locating holes 41 sleeve the locating pillars 11, the cover body 2 is covered on the base 1 to stop the mounting frame 4 in the base 1 and to stop the magnetic attraction member 3 in the limiting gap 5. The magnetic attraction member 3 includes a hollow iron tube 31 and a magnet 32. The magnet 32 is located in the iron tube 31. One end of the iron tube 31 is provided with a first opening 311. The other end of the iron tube 31 is provided with a second opening 312. The mounting frame 4 includes a first clamping piece 42 and a second clamping piece 43. The first clamping piece 42 is provided with a first connection end 421 and a first clamping end 422. The second clamping piece 43 is provided with a second connection end 431 and a second clamping end 432. When the first clamping end 422 is plugged to the first opening 311, and the second clamping end 432 is plugged to the second opening 312, the first connection end 421 is connected to the second connection end 431, so that the first clamping piece 42 and the second clamping piece 43 clamp the iron tube 31, and the magnetic attraction member 3 and the mounting frame 4 are combined into a whole.

A transverse length of the iron tube is greater than that of the magnet. Specifically, the transverse, length of the iron tube is twice that of the magnet.

By means of the above structure, the magnetic attraction member can be exposed from the base and the cover body through the limiting gap. Compared with the prior art that a magnet is arranged in a'plastic shell and fails in direct contact such that the magnetism is lowered, the present disclosure achieves direct contact between magnetic attraction toys, thus enhancing the first stage of magnetic force. Furthermore, the magnetic attraction member includes the iron tube and the magnet located in the iron tube, so that the transverse length of the iron tube can be set to be greater than that of the magnet. Specifically, the transverse length of the iron tube can be set to be twice that of the magnet, and the first clamping end and the second clamping end can be inserted into two ends of the iron tube, so that a magnetic attraction contact area between, the magnetic attraction toys can be multiplied, and the magnet can still be fixed in a center position of the iron tube to provide a stronger and more stable magnetic attraction force, thus enhancing the second stage of magnetic force. In addition, the iron tube wrapping around the magnet makes magnetic induction lines around the magnet distributed intensively, so that the magnetic induction intensity around a surface of the magnetic attraction body becomes stronger, thus enhancing the third stage of magnetic force. A surface contact magnetic force of the magnetic attraction toy is enhanced by superposition of the enhancement of the three stages of magnetic forces, so that a user can put out a more three-dimensional, complicated and stable model using the magnetic attraction building blocks without increasing the cost for a strong magnet, and children's imagination can be developed more fully, which greatly increases the fun of experience of children. In addition, the first clamping piece and the second clamping piece are respectively clamped to two ends of the iron tube. On the one hand, the ribs welded with the first clamping piece and the second clamping piece are arranged on the base and the cover body, so that the number of welding lines is greatly increased, and a decrease in the quality of a product caused by difficulty in finding lack of weld is prevented. On the other hand, the thickness of an entire plastic building block is greatly increased, so that the overall torque resistance and tensile strength are greatly improved in order that children think a toy building block body cannot be broken with bare hands. A safety threat caused by the following fact can be effectively avoided: when playing the toy, a child swallows the magnet carelessly since a toy shell is broken. The safety of the magnetic attraction toy is then improved. Further, every country does not allow strong magnets to be exposed in children's products. The magnet is fixed in the iron tube. On the one hand, this regulation is met, and on the other hand, the magnetic attraction toys can be in direct contact through the surfaces of the iron tubes. Meanwhile, magnetic fields around the magnet are also strengthened.

In this embodiment, the base and the cover body can be provided with triangular, square, hexagonal, pentagonal, rhombus-shaped, trapezoid, fan-shaped or semicircular cross sections or cross sections in other shapes. When the base and the cover body can be provided with square cross sections, there are four magnetic attraction members and four mounting frames, which are respectively arranged on an upper side, lower side, left side and right side of the square, base.

The first connection end 421 is a groove, and the second connection end 431 is a convex block matched with the groove 421. When the first clamping end 422 is plugged to the first opening 311, and the second clamping end 432 is plugged to the second opening 312, the convex block is connected with the groove. Specifically, the first clamping piece 42 and the second clamping piece 43 are both plastic clamping pieces. One end of the magnet 32 is an N pole, and the other end of the magnet 32 is an S pole. By means of the above structure, the magnetic attraction toy is simple in structure, reasonable in design and stable in connection, so that connection between the magnetic attraction member and the mounting frame is effectively achieved. Further, by means of the cooperation between the groove and the convex block, a position offset between the first clamping piece and the second clamping piece can be effectively prevented, so that the first clamping end of the first clamping piece and the second clamping end of the second clamping piece stably clamp the iron tube. Specifically, one end of the magnet is an N pole, and the other end of the magnet is an S pole, so that the N pole of the magnetic attraction toy can be easily guided to attract the S pole of another same magnetic attraction toy, and the S pole of the magnetic attraction toy can be guided to attract the N pole of another same magnetic attraction toy, so as to achieve stable connection between the magnetic attraction toys and facilitate the user to build a three-dimensional model. Further, the first clamping end 422 has a narrow front portion and a wide rear portion, and the second clamping end 432 has a narrow front portion and a wide rear portion, so that a first guide portion 423 is formed at a front end of the first clamping end, and a second guide portion 433 is formed at a front end of the second clamping end, and the first clamping end and the second clamping end can be inserted into the two ends of the iron tube to clamp the iron tube.

In this embodiment, the locating pillars 11 include a first locating pillar unit 111 and a second locating pillar unit 112. The locating holes 41 include a first locating hole unit 411 formed in the first clamping piece 42 and a second locating hole unit 412 formed in the second clamping piece 43. When the first clamping end 422 is plugged to the first opening 311 and the second clamping end 432 is plugged to the second opening 312, and when the first locating hole unit 411 sleeves, the first locating pillar unit 111 and the second locating hole unit 412 sleeves the second locating pillar unit 112, the cover body 2 is covered on the base 1 to stop the first locating pillar unit 111 in the first locating hole unit 411 and stop the second locating pillar unit 112 in the second locating hole unit 412, so as to stop the mounting frame 4 in the base 1. The magnetic attraction member 3 is stopped in the limiting gap 5. The cover body 2 is provided with a stop edge 21. When the cover body 2 is covered on the base 1, the stop edge 21 abuts against the first locating pillar unit 111 and the second locating pillar unit 112 to stop the first locating pillar unit 111 in the first locating hole unit 411 and stop the second locating pillar unit 112 in the second locating hole unit 412, so that the magnetic attraction member 3 is stopped in the limiting gap 5. Specifically, a raised first rib 12 is also arranged on the base 1. When the first clamping end 422 is plugged to the first opening 311 and the second clamping end 432 is plugged to the second opening 312, and when the first locating hole unit 411 sleeves the first locating pillar unit 111 and the second locating hole unit 412 sleeves the second locating pillar unit 112, the first clamping piece 42 and the second clamping piece 43 are both connected with the first rib 12 by means of ultrasonic line welding. Further, a raised second rib 22 is arranged on the cover body 2. When the first locating hole unit 411 sleeves the first locating pillar unit 111 and the second locating hole unit 412 sleeves the second locating pillar unit 112, and when the cover body 2 is covered on the base 1, the first clamping piece 42 and the second clamping piece 43 are both connected with the second rib 22 by means of ultrasonic line welding. Much further, when the cover body is covered on the base, a first stop edge abuts against a first locating pillar and a second locating pillar to stop and press the first clamping piece and the second clamping piece to the base, so that the magnetic attraction member is stopped in the limiting gap. By means of the above structure, connection among the magnetic attraction member, the mounting frame and the base is effectively achieved. The mounting frame is stably fixed on the base by connecting the locating holes of the mounting frame to the locating pillars on the base in a sleeving manner. The first clamping piece and the second clamping piece are both connected with the first rib by means of the ultrasonic line welding, and the first clamping piece and the second clamping piece are both connected with the second rib by means of the ultrasonic line welding, so that the first clamping piece and the second clamping piece are stably mounted between the cover body and the base; the first clamping piece and the second clamping piece can be effectively prevented from being separated from the locating pillars, thus preventing the magnetic attraction member clamped by the first clamping piece and the second clamping piece from being separated from the limiting gap; and the situation that a child carelessly swallows the loosened magnetic attraction member is prevented, thus further improving the safety and stability of the magnetic attraction, toy. Furthermore, a three-dimensional model built using the magnetic attraction toy is more stable. Further, by means of adding the first rib and the second rib inside, the welding area is enlarged, the process risk of lack of weld is effectively avoided, the quality of a product is improved, and the reject ratio of products is reduced.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A magnetic attraction toy, comprising a base, a cover body, a magnetic attraction member and a mounting frame, wherein the magnetic attraction member is connected with the mounting frame; the base and/or the cover body is provided with a limiting gap for accommodating the magnetic attraction member; the base is also provided, with locating pillars; the mounting frame is provided with locating holes; when the locating holes sleeve the locating pillars, the cover body is covered on the base to stop the mounting frame in the base and to stop the magnetic attraction member in the limiting gap; the magnetic attraction member comprises a hollow iron tube and a magnet; the magnet is located in the iron tube; one end of the iron tube is provided with a first opening; the other end of the iron tube is provided with a second opening; the mounting frame comprises a first clamping piece and a second clamping piece; the first clamping piece is provided with a first connection end and a first clamping end; the second clamping piece is provided with a second connection end and a second clamping end; when the first clamping end is plugged to the first opening, and the second clamping end is plugged to the second opening, the first connection end is connected to the second connection end, so that the first clamping piece and the second clamping piece clamp the iron tube, and the magnetic attraction member and the mounting frame are combined into a whole.

2. The magnetic attraction toy according to claim 1, wherein the first connection end is a groove, and the second connection end is a convex block matched with the groove; and when the first clamping end is plugged to the first opening, and the second clamping end is plugged to the second opening, the convex block is connected with the groove.

3. The magnetic attraction toy according to claim 2, wherein the locating pillars comprise a first locating pillar unit and a second locating pillar unit; the locating holes comprise a first locating hole unit formed in the first clamping piece and a second locating hole unit formed in the second clamping piece; when the first clamping end is plugged to the first opening and the second clamping end is plugged to the second opening, and when the first locating hole unit sleeves the first locating pillar unit and the second locating hole unit sleeves the second locating pillar unit, the cover body is covered on the base to stop the first locating pillar unit in the first locating hole unit and stop the second locating pillar unit in the second locating hole unit, so as to stop the mounting frame in the base; and the magnetic attraction member is stopped in the limiting gap.

4. The magnetic attraction toy according to claim 3, wherein the cover body is provided with a stop edge; and when the cover body is covered on the base, the stop edge abuts against the first locating pillar unit and the second locating pillar unit to stop the first locating pillar unit in the first locating hole unit and stop the second locating pillar unit in the second locating hole unit, so that the magnetic attraction member is stopped in the limiting gap.

5. The magnetic attraction toy according to claim 3, wherein a raised first rib is also arranged on the base; and when the first clamping end is plugged to the first opening and the second clamping end is plugged to the second opening, and when the first locating hole unit sleeves the first locating pillar unit and the second locating hole unit sleeves the second locating pillar unit, the first clamping piece and the second clamping piece are both connected with the first rib by means of ultrasonic line welding.

6. The magnetic attraction toy according to claim 5, wherein a raised second rib is arranged on the cover body; and when the first locating hole unit sleeves the first, locating pillar unit and the second locating hole unit sleeves the second locating pillar unit, and when the cover body is covered on the base, the first clamping piece and the second clamping piece are both connected with the second rib by means of ultrasonic line welding.

7. The magnetic attraction toy according to claim 1, wherein the first clamping piece and the second clamping piece are both plastic clamping pieces.

8. The magnetic attraction toy according to claim 1, wherein one end of the magnet is an N pole, and the other end of the magnet is an S pole.

9. The magnetic attraction toy according to claim 1, wherein a transverse length of the iron tube is greater than a transverse length of the magnet.

10. The magnetic attraction toy according to claim 9, wherein the transverse length of the iron tube is twice the transverse length of the magnet.

11. A magnetic attraction toy, comprising a base, a cover body, a magnetic attraction member and a mounting frame, wherein the magnetic attraction member is connected with the mounting frame; the base is provided with a limiting gap for accommodating the magnetic attraction member;

the base is also provided with locating pillars; the mounting frame is provided with locating holes; when the locating holes sleeve the locating pillars respectively, the cover body is covered on the base to stop the mounting frame in the base so as to stop the magnetic attraction member in the limiting gap;

the magnetic attraction member comprises a hollow iron tube and a magnet; the magnet is located in the iron tube; one end of the iron tube is provided with a first opening; the other end of the iron tube is provided with a second opening;

the mounting frame comprises a first clamping piece and a second clamping piece; the first clamping piece is provided with a first connection end and a first clamping end; the second clamping piece is provided with a second connection end and a second clamping end;

when the first clamping end is plugged to the first opening, and the second clamping end is plugged to the second opening, the first connection end is connected to the second connection end, so that the first clamping piece and the second clamping piece clamp the iron tube, and the magnetic attraction member and the mounting frame are connected.

12. The magnetic attraction toy according to claim 11, wherein the first connection end is a groove, and the second connection end is a convex block matched with the groove; and when the first clamping end is plugged to the first opening, and the second clamping end is plugged to the second opening, the convex block, is connected with the groove.

13. The magnetic attraction toy according to claim 12, wherein the locating pillars comprise a first locating pillar unit and a second locating pillar unit; the locating holes comprise a first locating hole unit formed in the first clamping piece and a second locating hole unit formed in the second clamping piece; when the first clamping end is plugged to the first opening and the second clamping end is plugged to the second opening, and when the first locating hole unit sleeves the first locating pillar unit, and the second locating hole unit sleeves the second locating pillar unit, the cover body is covered on the base to stop the first locating pillar unit in the first locating hole unit and stop the second locating pillar unit in the second locating hole unit, so as to stop the mounting frame in the base; and the magnetic attraction member is stopped in the limiting gap.

14. The magnetic attraction toy according to claim 13, wherein the cover body is provided with a stop edge; and when the cover body is covered on the base, the stop edge abuts against the first locating pillar unit and the second locating pillar unit to stop the first locating pillar unit in the first locating hole unit and stop the second locating pillar unit in the second locating hole unit, so that the magnetic attraction member is stopped in the limiting gap.

15. The magnetic attraction toy according to claim 13, wherein a raised first rib is also arranged on the base; and when the first clamping end is plugged to the first opening and the second clamping end is plugged to the second opening, and when the first locating hole unit sleeves the first locating pillar unit and the second locating hole unit sleeves the second locating pillar unit, the first clamping piece and the second clamping piece are both connected with the first rib by means of ultrasonic line welding.

16. The magnetic attraction toy according to claim 15, wherein a raised second rib is arranged on the cover body; and when the first locating hole unit sleeves the first locating pillar unit and the second locating hole unit sleeves the second locating pillar unit, and when the cover body is covered on the base, the first clamping piece and the second clamping piece are both connected with the second rib by means of ultrasonic line welding.

17. The magnetic attraction toy according to claim 11, wherein the first clamping piece and the second clamping piece are both plastic clamping pieces.

18. The magnetic attraction toy according to claim 11, wherein one end of the magnet is an N pole, and the other end of the magnet is an S pole.

19. The magnetic attraction toy according to claim 11, wherein a transverse length of the iron tube is greater than a transverse length of the magnet.

20. The magnetic attraction toy according to claim 19, wherein the transverse length of the iron tube is twice the transverse length of the magnet.

* * * * *